US009551962B2

(12) United States Patent
Campbell et al.

(10) Patent No.: US 9,551,962 B2
(45) Date of Patent: Jan. 24, 2017

(54) HYBRID HEATER WITH DUAL FUNCTION HEATING CAPABILITY

(71) Applicant: Lexmark International, Inc., Lexington, KY (US)

(72) Inventors: Michael Clark Campbell, Lexington, KY (US); Paul Wesley Etter, Lexington, KY (US); James Adrian Riley, Richmond, KY (US); Jerry Wayne Smith, Irvine, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 44 days.

(21) Appl. No.: 14/144,110

(22) Filed: Dec. 30, 2013

(65) Prior Publication Data

US 2015/0083706 A1 Mar. 26, 2015

Related U.S. Application Data

(60) Provisional application No. 61/882,462, filed on Sep. 25, 2013.

(51) Int. Cl.
*H05B 3/00* (2006.01)
*G03G 15/20* (2006.01)

(52) U.S. Cl.
CPC ..... *G03G 15/2057* (2013.01); *G03G 15/205* (2013.01); *G03G 15/2042* (2013.01); *G03G 2215/2035* (2013.01)

(58) Field of Classification Search
CPC ..... G03G 15/2057; G03G 15/2064; G03G 15/2039; G03G 15/20; G03G 15/205; G03G 15/206; G03G 15/2042; G03G 15/2053; G03G 2215/2035;G03G 2215/2038; G03G 2215/2041; G03G 2215/2029; G03G 2215/2016
See application file for complete search history.

(56) References Cited

U.S. PATENT DOCUMENTS 5,162,635 A 11/1992 Sato et al.
5,171,969 A 12/1992 Nishimura et al.
(Continued)

FOREIGN PATENT DOCUMENTS

JP 07-199697 8/1995
JP 2006012444 1/2006
JP 2008-268729 11/2008

OTHER PUBLICATIONS

Hsiao-Lin, Wang, Structure and Dielectric Properties of Perovskite-Barium Titanate, San Jose State Univ., Dec. 2002, pp. 1-5.
(Continued)

*Primary Examiner* — Shawntina Fuqua

(57) ABSTRACT

A fuser heater member for an electrophotographic imaging device, including a heater member. According to an example embodiment, the heater member includes positive temperature coefficient (PTC) material disposed along a width of a fuser nip of the fuser assembly; first and second electrodes disposed along disposed surfaces of the PTC material; an intermediate layer disposed over the second electrode; and at least one resistive trace disposed along the intermediate layer along the width of the fuser nip. The heater member includes a plurality of wire segments coupled to the first and second electrodes and the resistive elements for use in generating heat from at least one of the PTC material and the at least one resistive trace during a fusing operation.

25 Claims, 14 Drawing Sheets

(56) References Cited

U.S. PATENT DOCUMENTS

| | | | | |
|---|---|---|---|---|
| 5,191,381 | A | 3/1993 | Yuan | |
| 5,204,723 | A | 4/1993 | Hanada et al. | |
| 5,499,087 | A | 3/1996 | Hiraoka et al. | |
| 5,640,231 | A | 6/1997 | Mitsui et al. | |
| 5,660,750 | A | 8/1997 | Kusaka | |
| 5,915,146 | A | 6/1999 | Kusaka et al. | |
| 6,084,208 | A | 7/2000 | Okuda et al. | |
| 6,090,313 | A | 7/2000 | Zhao | |
| 6,185,383 | B1 | 2/2001 | Kanari et al. | |
| 6,221,800 | B1 | 4/2001 | Takahashi et al. | |
| 6,336,009 | B1 | 1/2002 | Suzumi et al. | |
| 6,462,643 | B1 | 10/2002 | Fujii et al. | |
| 6,580,883 | B2 | 6/2003 | Suzumi | |
| 6,826,382 | B2 * | 11/2004 | Sanpei | G03G 15/2053 219/216 |
| 7,092,652 | B2 | 8/2006 | Matsumoto | |
| 2002/0094212 | A1 | 7/2002 | Suzumi | |
| 2004/0126127 | A1 | 7/2004 | Fujimori et al. | |
| 2005/0008410 | A1 | 1/2005 | Arcaro et al. | |
| 2005/0145617 | A1 * | 7/2005 | McMillin | H05B 3/28 219/543 |
| 2005/0158063 | A1 | 7/2005 | Mizuno | |
| 2006/0024071 | A1 | 2/2006 | Takami | |
| 2007/0230981 | A1 | 10/2007 | Cho | |
| 2008/0003027 | A1 | 1/2008 | Su | |
| 2008/0031648 | A1 | 2/2008 | Iwasaki et al. | |
| 2008/0124150 | A1 * | 5/2008 | Schuman | G03G 15/2057 399/333 |
| 2008/0135535 | A1 | 6/2008 | Brun et al. | |
| 2009/0263170 | A1 | 10/2009 | Kagawa et al. | |
| 2010/0303524 | A1 | 12/2010 | Cao et al. | |
| 2011/0158691 | A1 | 6/2011 | Foster et al. | |
| 2011/0299904 | A1 * | 12/2011 | Oishi | G03G 15/2053 399/329 |
| 2012/0051766 | A1 | 3/2012 | Ueno et al. | |
| 2012/0070207 | A1 | 3/2012 | Cao et al. | |
| 2012/0155937 | A1 * | 6/2012 | Hamilton | G03G 15/2042 399/333 |
| 2012/0195658 | A1 * | 8/2012 | Sakakibara | G03G 15/2057 399/333 |
| 2013/0026154 | A1 | 1/2013 | Taniguchi | |
| 2013/0322897 | A1 | 12/2013 | Yago et al. | |
| 2014/0076878 | A1 | 3/2014 | Shimura | |
| 2014/0169845 | A1 | 6/2014 | Nakahara et al. | |
| 2015/0086231 | A1 | 3/2015 | Bush et al. | |
| 2015/0086232 | A1 | 3/2015 | Campbell et al. | |

OTHER PUBLICATIONS

Miclea et al., "Advanced Electroceramic Materials for Electrotechnical Applications," The Journal of Optoeletronics and Advanced Materials, vol. 4, No. 1, Mar. 2002, pp. 51-58.

Y. Chen et al., "Ni—BaTiO3 Interface Phenomenon of Co-fired PTCR by Aqueos Tape Casting," Transactions of Nonferrous Metals Society of China, Sep. 2007, pp. 1391-1395.

PCT International Search Report and Written Opinion of the International Searching Authority for PCT application PCT/US14/71951, Mar. 24, 2015.

U.S. Appl. No. 14/144,191, including Notice of Allowance dated Sep. 2, 2015.

* cited by examiner

HYBRID HEATER WITH DUAL FUNCTION HEATING CAPABILITY

CROSS REFERENCES TO RELATED APPLICATIONS

The present application is related to U.S. patent application Ser. No. 12/971,679, filed Dec. 17, 2010, and entitled, "Fuser Heating Element for an Electrophotographic Imaging Device," the content of which is incorporated by reference herein in its entirety. The present application claims priority under 35 U.S.C. 119(e) from U.S. provisional application No. 61/882,462, filed Sep. 25, 2013, entitled, "Hybrid Fuser Heater of a Belt Fuser Using Heat Control Circuitry," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to a fuser in an electrophotographic imaging device, and particularly to a heater of a belt fuser and controlling heat generation of the heater.

2. Description of the Related Art

In laser imaging devices, toner transferred to sheets of media using various electrophotographic techniques are then fused to the media by a fuser which applies heat and pressure to the toner. The heat and pressure are applied at a fusing nip formed in part by a backup roll. The fuser substantially permanently bonds the toner to the media as the media passes through the fuser nip. Toner fusing is the final step in the printing process of a laser imaging device.

There are a number of different fuser architectures, such as a hot roll fuser and a belt fuser. Belt fusers use a belt that is thinner than a hot roll in the hot roll fuser. The belt fuser thus has lower thermal mass to reduce warm-up time and energy usage for a faster and more efficient printing process.

However, the lower thermal mass of a belt fuser presents challenges when printing on narrow media. This is because the portions of the fuser nip that do not contact narrow media sheets quickly overheat, thereby potentially damaging some parts of the belt fuser. Belt fuser damage can be avoided by slowing the printing process, such as increasing the gap between successive pages in the media path, whenever narrow media is used. By slowing the printing process speed, the excess heat is allowed to conduct axially from the portion of the fuser nip through which the narrow media passes. In contrast, the hot roll fuser spreads excess heat axially even without slowing printing on the narrow media.

What is needed is a belt fuser that prints at roughly the same speeds as a hot roll fuser when printing on narrow media, while maintaining its fast warm-up and energy efficiency.

SUMMARY

Example embodiments of the present disclosure provide a hybrid fuser heater for a belt fuser that incorporates a heater design architecture that provides faster print process speeds using narrow media, efficient fusing operation and relatively fast warm-up times.

In an example embodiment, a heater for a belt fuser assembly includes a positive temperature coefficient (PTC) material, first and second electrodes, an intermediate layer, one or more resistive traces and a protective layer. The PTC material has a first surface and an opposed second surface, and a length of the PTC material is sized to extend across a width of a fuser nip of the belt fuser assembly. The first electrode and the second electrode are disposed against the first surface and the second surface of the PTC material, respectively. The electrodes may be utilized for applying a voltage differential across the PTC material when the electrodes are coupled to an AC line voltage, for generating heat. The intermediate layer is disposed against the second electrode. The one or more resistive traces are disposed along the intermediate layer to extend substantially across the length of the PTC material for generating heat upon passage of a current through the one or more resistive traces. The protective layer substantially covers the one or more resistive traces and the intermediate layer. The protective layer and the intermediate layer may be one of a polyimide and a glass composition. The heater includes a conductor that electrically connects together the second electrode and a first end portion of the one or more resistive traces.

In another example embodiment, the intermediate layer may be a rigid substrate having a length corresponding to the length of the PTC material and may include a thermal grease layer disposed between the substrate and second electrode. The substrate may be a ceramic. The rigid substrate advantageously allows the PTC material to be thinner for more efficient heat delivery while preventing the PTC material from cracking.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
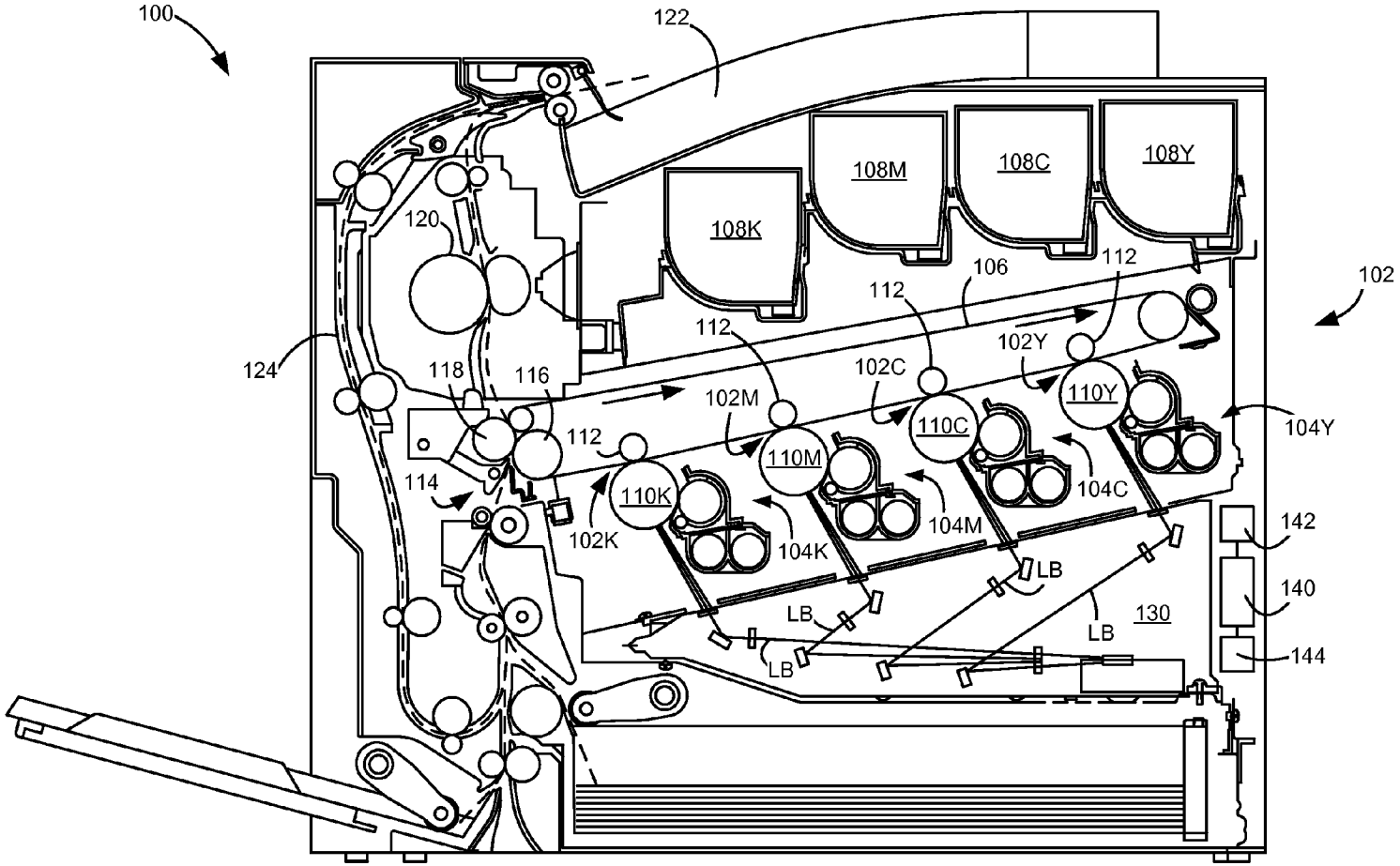
FIG. 1 is a side elevational view of an image forming device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top," "bottom," "front," "back" and "side," "above," "under," "below," "lower," "over," "upper," and the like, are used for ease of description to explain the positioning of one element relative to a second element. Terms such as "first," "second," and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first toner transfer area 102 having four developer units 104 that substantially extend from one end of image forming device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming operations, ITM 106 moves past photoconductive members 110 in a clockwise direction as viewed in FIG. 1. One or more of photoconductive members 110 applies its toner image in its respective color to ITM 106. For mono-color images, a toner image is applied from a single photoconductive member 110K. For multi-color images, toner images are applied from two or more photoconductive members 110. In one example embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

A fuser assembly 120 is disposed downstream of second transfer area 114 and receives media sheets with the unfused toner images superposed thereon. In general, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Image forming device 100 is depicted in FIG. 1 as a color laser printer in which toner is transferred to a media sheet in a two step operation. Alternatively, image forming device 100 may be a color laser printer in which toner is transferred to a media sheet in a single step process—from photoconductive members 110 directly to a media sheet. In another alternative example embodiment, image forming device 100 may be a monochrome laser printer which utilizes only a single developer unit 104 and photoconductive member 110 for depositing black toner directly to media sheets. Further, image forming device 100 may be part of a multi-function product having, among other things, an image scanner for scanning printed sheets.

Image forming device 100 further includes a controller 140 and memory 142 communicatively coupled thereto. Though not shown in FIG. 1, controller 140 may also be coupled to components and modules in image forming device 100 for controlling the same. For instance, controller 140 may be coupled to toner reservoirs 108, developer units 104, photoconductive members 110, fuser assembly 120 and/or LSU 130 as well as to motors (not shown) for imparting motion thereto. Further, controller 140 is associated with heat control circuitry 144 that is coupled to fuser assembly 120 to control the generation of heat used to fuse toner to sheets of media. It is understood that controller 140 may be implemented as any number of controllers and/or processors for suitably controlling image forming device 100 to perform, among other functions, printing operations.

Figure 2:
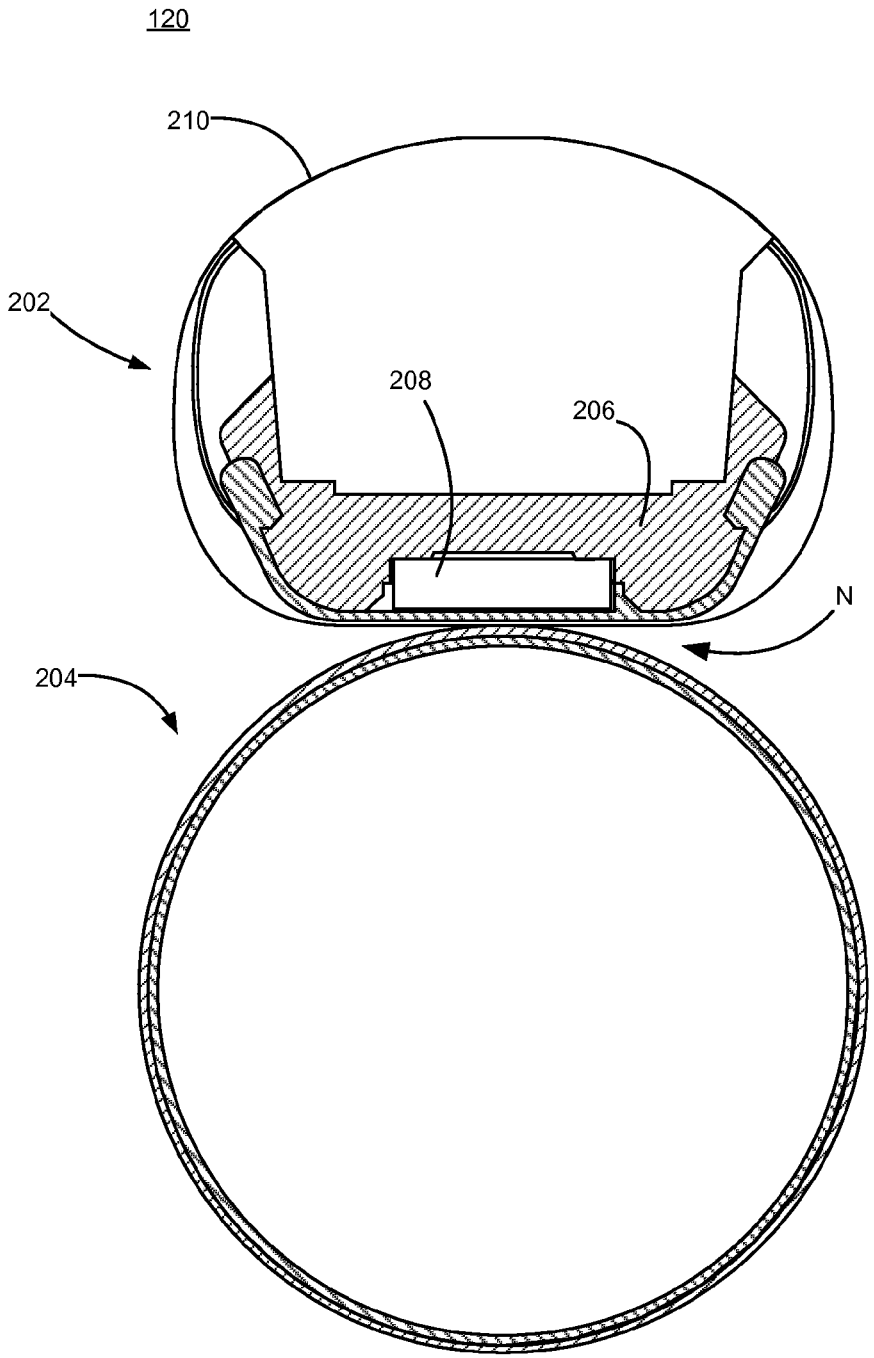
FIG. 2 is a cross sectional view of a fuser assembly of FIG. 1.

With respect to FIG. 2, fuser assembly 120 may include a heat transfer member 202 and a backup roll 204 cooperating with heat transfer member 202 to define a fuser nip N for conveying media sheets therein. The heat transfer member 202 may include a housing 206, a heater member 208 supported on and/or at least partially in housing 206, and an endless flexible fuser belt 210 positioned about housing 206.

Fuser belt 210 is disposed around housing 206 and heater member 208 for moving thereabout. The fuser belt 210 may be a stainless steel belt for higher process speeds when printing. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to fuse toner to sheets of media.

Backup roll 204 may include a center core component around which one or more layers are disposed. Backup rolls are known in the art such that a detailed description of backup roll 204 will not be provided for reasons of expediency. Backup roll 204 may be driven by a motor (not shown). The motor may be any of a number of different types of motors. For instance, the motor may be a brushless D.C. motor or a stepper motor and may also be coupled to backup roll 204 by a number of mechanical coupling mechanisms, including but not limited to a gear train (not shown).

During a fusing operation, heat control circuitry 144 controls heater member 208 to generate heat within the desired range of fusing temperatures. Further, controller 140 may control the motor driving backup roll 204 to cause it to rotate at a desired fusing speed during the fusing operation. The desired fusing speed and range of fusing temperatures are selected for achieving relatively high processing speeds as well as effective toner fusing without appreciably affecting the useful life of components of fuser assembly 120 (e.g., backup roll 204 and fuser belt 210).

Figure 3:
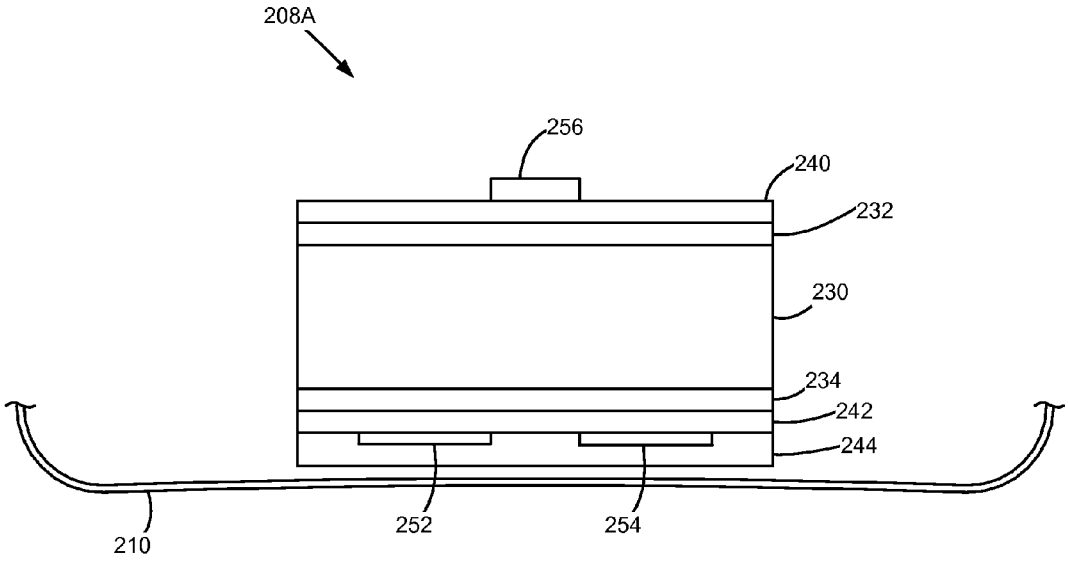
FIG. 3 is a cross sectional view of a heater member of FIG. 2 according to a first example embodiment.

FIG. 3 is a cross sectional elevational view of the heater member 208 according to a first example embodiment. In this example embodiment, heater member 208A includes a positive temperature coefficient (PTC) material 230 and top and bottom electrodes 232, 234 attached at opposed sides thereof for applying a voltage differential across PTC material 230 to generate heat therefrom. The heater member 208A also includes a top protective layer 240 and an intermediate protective layer 242 covering the outer surfaces of electrodes 232 and 234, respectively. Heater member 208A further includes at least one resistive trace for generating heat when current is passed therethrough. In particular, heater member 208A includes resistive traces 252, 254 disposed along and secured to intermediate protective layer 242. Heater member 208A is capable of heating media sheets passing through fuser nip N using PTC material 230 and/or resistive traces 252, 254 as will be explained in greater detail below.

To provide a substantially wear-resistant outer surface which contacts fuser belt 210, heater member 208A includes a bottom protective layer 244 that substantially covers resistive traces 252, 254 and the outer surface of intermediate protective layer 242 not covered by resistive traces 252, 254. Heater member 208A also includes at least one temperature sensor, such as a thermistor 256, coupled to or mounted substantially in contact with top protective layer 240. Thermistor 256 is used to sense the temperature of heater member 208A.

In one example embodiment, PTC material 230 is shaped as a rectangular prism having substantially the same rectangular cross section along the length of the prism. A length of PTC material 230 extends laterally in fuser nip N, orthogonal to the direction of media flow therein, so that heat element 208A may effectively heat media sheets having narrow widths and media sheets having the largest width on which image forming device 100 is capable of printing. For example, the length of PTC material 230 may be about 220 mm for an A4 image forming device 100. In addition, the width of PTC material 230 is defined by a desired length of fuser nip N. The width of PTC material 230 may be between about 8 mm and about 16 mm. It is understood that a thinner PTC material 230 provides for more efficient heat transfer to the toner being fused, and a thicker PTC material 230 provides for better structural rigidity of heater member 208A. In the example embodiment, the thickness of PTC material 230 may be about 0.8 mm to about 2.2 mm, and particularly between about 1.2 mm to about 1.6 mm.

In the example embodiments, PTC material 230 has a Perovskite ceramic crystalline structure. In one example embodiment, the PTC material 230 is a barium titanate ($BaTiO_3$) composition. The $BaTiO_3$ composition is used in production of piezoelectric transducers, multi-layer capacitors and PTC thermistors due to ferroelectric behavior of $BaTiO_3$ such that the $BaTiO_3$ composition exhibits spontaneous polarization at temperatures below its corresponding Curie temperature (about 120 C). Pure $BaTiO_3$ ceramic is an insulator but can be made a semiconductor by controlled doping. In one example embodiment, the $BaTiO_3$ composition is doped with strontium (Sr) and/or lead (Pb), where Sr is used to lower the Curie point of the material and Pb is used to increase the Curie point thereof. Doping the $BaTiO_3$ composition this way changes grain boundary conditions such that above the Curie point, the resistance of PTC material 230 substantially increases. The effect of such doping is known as the positive temperature coefficient of resistivity (PTCR) effect. For example, Pb doping percentages may be between about 12 percent and about 20 percent, yielding a Curie point between about 180 C and about 220 C. In an alternative embodiment, the Curie point range based on desired operating temperature of fuser assembly 120 may be between about 220 C and about 300 C. In forming PTC material 230, conventional ceramic fabrication processes may be utilized to produce the doped $BaTiO_3$. Some example processes may include tape casting, roll compaction, slip casting, dry pressing and injection molding. As a result, PTC material 230 is provided so that within a predetermined temperature range, the electrical resistivity thereof varies very little and is otherwise substantially constant (depending on power requirements of heater member 208A), but at temperatures above the predetermined range, the electrical resistivity of PTC material 230 rises markedly.

For heater member 208A being sized to fuse media sheets of A4 sheet size or more and for providing a nominal heating power range of about 600 W to about 1200 W, the resistivity range of PTC material 230 may be from about 875 ohm-cm to about 16,200 ohm-cm. The predetermined fusing temperature range may be operating temperatures of fuser assembly 120 at which toner is fused to media (e.g., between about 200 C and about 240 C).

In an example embodiment, PTC material 230 is heated to provide heating to fuse narrow media at speeds up to at least about 35 pages per minute (ppm). Top and bottom electrodes 232, 234 are constructed from electrically conductive material. In one example embodiment, each electrode 232, 234 is a silver compound having a thickness of about 10 microns. The width and length of each of electrodes 232, 234 may be sized to extend substantially along PTC material 230 across its major surfaces. The electrodes 232, 234 are mechanically, thermally and electrically coupled to PTC material 230 using attachment mechanisms such as ceramic glass cement or other adhesives.

Resistive traces 252, 254 may be constructed from any type of electrically resistive material which generates the requisite heat from passing AC current, such as from a 220 v or 120 v power supply, to flow therethrough. In this embodiment, resistive traces 252, 254 provide sufficient heat to fuse media having the largest or near largest printable widths for image forming device 100 (hereinafter "full width media") at speeds higher than about 35 ppm. Printing full-width media at significantly higher speeds using resistor heating, and printing narrow media at speeds up to about 35 ppm using heating by PTC material 230 is not otherwise possible using resistive heating alone. In one example embodiment, resistive traces 252 and 254 are two parallel traces, each about three millimeters wide and separated by a gap of about 0.5 mm to about 1.5 mm. In forming resistive traces 252 and 254, each resistive trace is printed on intermediate protective layer 242 using any of a variety of different methods (e.g., thick-film methods, or as thin metal foils disposed between intermediate and bottom protective layers 242, 244).

Bottom protective layer 244 acts as a protective coating against a relatively fast-moving fuser belt 210 and as an electrically insulative coating against the stainless steel belt 210. Bottom protective layer 244 thus provides a low friction surface for fuser belt 210 to slide against and insulates the AC current flowing through resistive traces 252, 254. According to an example embodiment, each of top layer 240, intermediate layer 242 and bottom protective layer 244 may be a glass layer. In addition, top, intermediate and bottom protective layers 240, 242, 244 may each have a thickness of about 50 microns to about 150 microns.

In an alternative example embodiment, one or more of protective layers 240, 242, 244 may be a polyimide layer instead of glass. Use of polyimide material for protective layers 242, 244 provides a number of benefits. In comparison with glass, polyimide material for layers 242, 244 acts as a bonding agent to give more flexibility for the lamination of resistive traces 252, 254 and allows thick-film screen printing or other methods for forming the polyimide layers. In addition, polyimide layers 242, 244 allow resistive traces 252, 254 to be formed using the methods specified above, and provides relatively good electrical insulation and mechanical lubricity properties not intrinsically available with heater member 208A, with the lubricity providing an improved outer surface of layer 244 against stainless steel belt 210.

Fusers that receive center-fed media will have two portions of fuser nip N that do not contact narrow media sheets, called "non-media zones," rather than a single non-media zone across fuser nip N for reference-edge-fed media. Typically, this will require more instrumentation for sensing temperature to quickly prevent overheating of the non-media zones, and more complexity for otherwise dealing with the two non-media zones. For the typical PTC heaters that have no resistive heating, however, heat will be generated where there is media, and the self-regulating behavior of the PTC will limit the heat generated in the two non-media zones. As such, the combination of PTC material 230 and layers 242, 244 of polyimide is synergistic in that the self-regulating properties of the typical PTC heater are incorporated with electrical insulation and mechanical lubricity properties of a polyimide-covered, resistive trace heater. Thus, the polyimide layers advantageously provide electrical insulation and lubricity when the PTC material generates heat and when the resistive traces generate heat.

In forming the polyimide layers, the PTC material 230 and bottom electrode 234 coupled thereto may be laminated with polyimide layers 242, 244. Such a heater may be made by applying intermediate protective layer 242 of polyimide over the bottom electrode 234. Resistive traces 252, 254 may then be added to the intermediate polyimide protective layer 242. Bottom polyimide protective layer 244 is then applied over intermediate protective layer 242 and resistive traces 252, 254. In some embodiments, the polyimide layers 242, 244 may be formed by thick-film printing methods or by dip coating methods which mask the areas that are free of polyimide material. Such a lamination is achievable because the imidization temperatures of the polyimide layers 242, 244 and the resistive traces 252, 254 do not exceed the firing temperature of PTC material 230. Overall, hybrid heater member 208A employing the protective layers 242, 244 made from glass or polyimide material maintains advantages over the pure PTC heater by improving narrow media print speeds, regardless of whether narrow media is center-fed or reference-edge-fed through fuser assembly 120.

Figure 4:
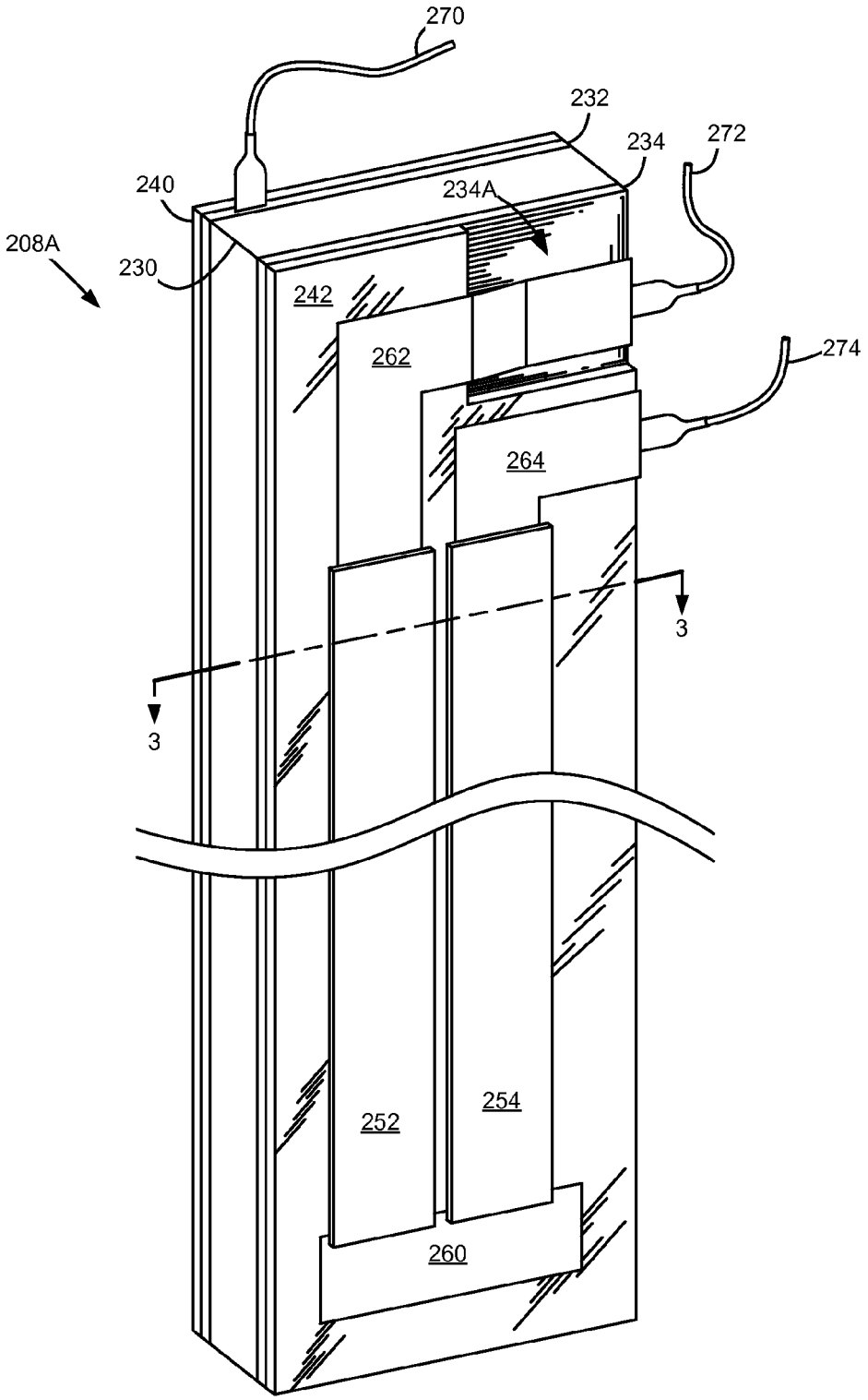
FIG. 4 is a bottom perspective view of the heater member of FIG. 3, with its bottom protective layer not shown, according to an example embodiment for connecting to a heat control circuitry.

FIG. 4 shows a bottom perspective view of the heater member 208A of FIG. 3, without bottom protective layer 244. Line 3-3 is the cross sectional view from which FIG. 3 was taken. Heater member 208A includes electrical conductors 260, 262 and 264 as well as electrical wires 270, 272 and 274. Intermediate protective layer 242 of heater member 208A has a relatively small cutout portion, to expose a portion 234A of bottom electrode 234.

Electrical conductors 260, 262, 264 may each be formed from any type of electrically conductive material, such as metal. Electrical conductors 260, 262, 264 are disposed on intermediate glass layer 242 and formed in a similar manner as resistive traces 252, 254. In this embodiment, the conductor trace 260 electrically shorts adjacent first ends of resistive traces 252, 254. In addition, electrical conductor 262 electrically connects together a second end of resistive trace 252, electrical wire 272 and bottom electrode 234 (via exposed portion 234A). Electrical conductor 264 electrically connects a second end of resistive trace 254 and the electrical wire 274. As such, an electrical path is formed for AC current to flow between wires 272 and 274 and through resistive traces 252, 254, for generating heat. In addition, with electrical conductor 262 connected to bottom electrode 234 and electrical wire 272, and with electrical wire 270 coupled to top electrode 232, an electrical path is created between electrical wires 270 and 272 for passing an electrical current through PTC material 230, thereby forming its voltage differential. In this way, the electrical wires 270, 272 and 274 form a three-wire connection to heater member 208A for causing heat to be generated by PTC material 230 and/or resistive traces 252, 254.

Figure 5:
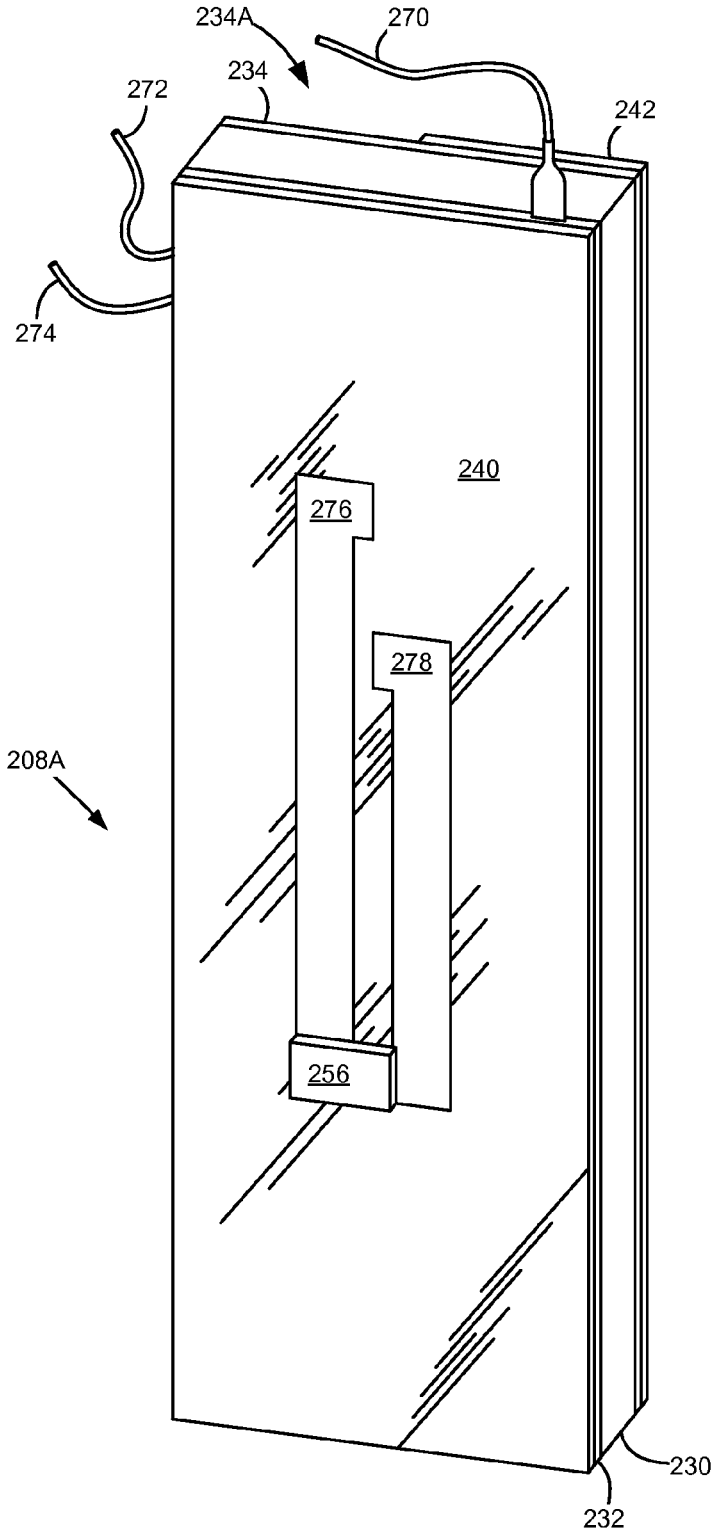
FIG. 5 is a top view of the heater member of FIG. 4.

FIG. 5 is a top view of the heater member 208A of FIG. 4. Heater member 208A includes electrical conductors 276, 278 disposed and/or formed on top of protective layer 240. Electrical conductors 276, 278 are electrically connected to thermistor 256 to provide a signal path for a signal generated thereby. Typically, the thermistor 256 senses the temperature of heater member 208A and then transmits an electrical signal pertaining thereto through said signal path. Electrical conductors 276, 278 may be coupled to controller 140 for providing thereto the electrical signal indicative of the temperature of heater member 208A.

In this embodiment, thermistor 256 is disposed on top protective layer 240 in a substantially central location along the length of PTC material 230.

Figure 6:
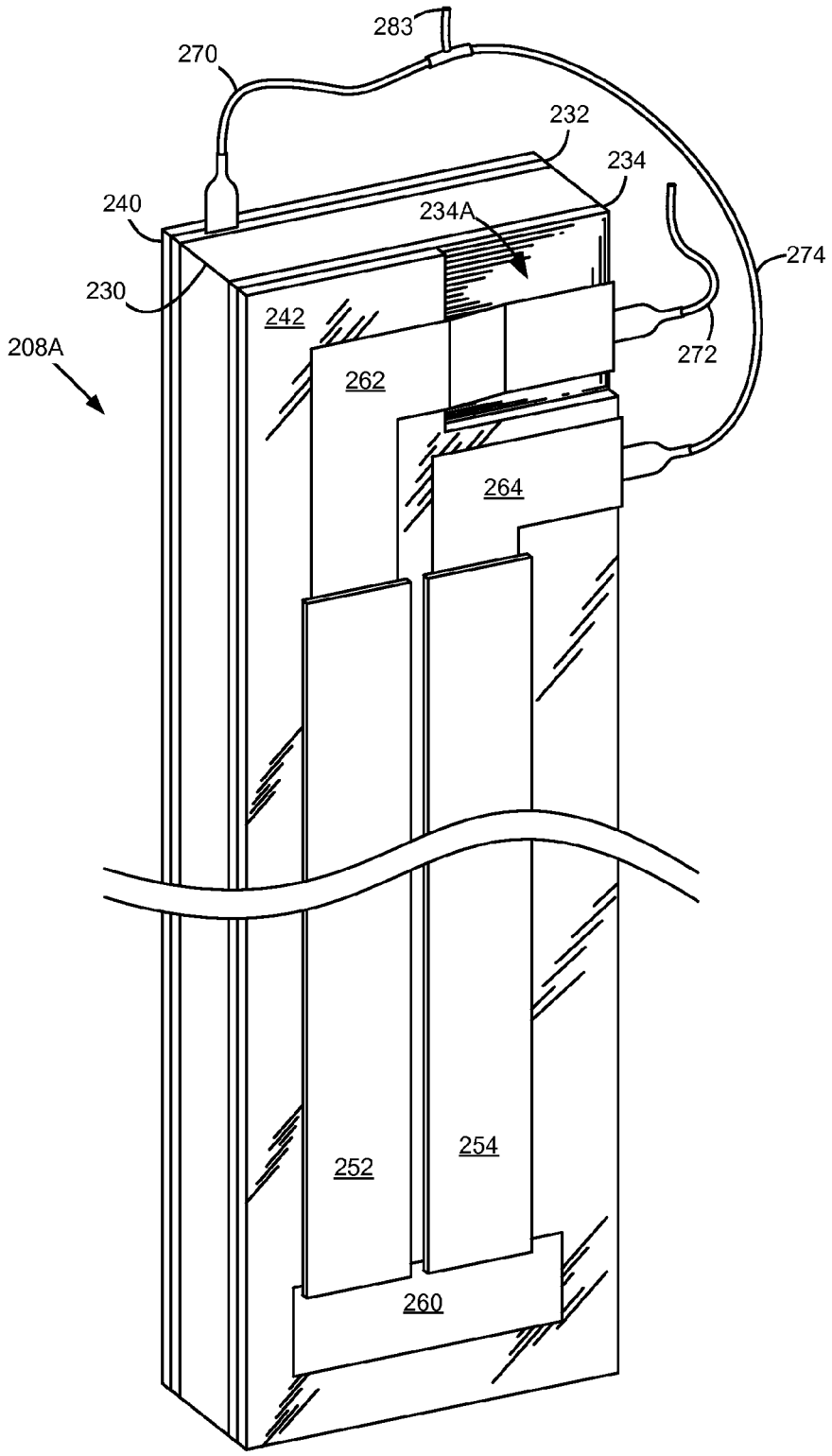
FIG. 6 is a bottom view of the heater member of FIG. 3, with its bottom protective layer also not shown, according to another example embodiment for connecting to the heat control circuitry.

FIG. 6 is a bottom view of the heater member 208A of FIG. 3, without bottom protective layer 244 being shown, according to another example embodiment for connecting to heat control circuitry 144. Heater member 208A has the basic structure as described above with respect to FIG. 4. However, instead of a three wire connection to the above-described heat control circuitry for controlling the heat generated by heater member 208A, the embodiment of FIG. 6 utilizes a two-wire connection. Specifically, electrical wires 270 and 274 are shorted together so as to electrically short top electrode 232 and resistive trace 254. Wire segment 283 may extend from wires 270 and 274 for providing an electrical connection to the above-described heat control circuitry. In this way, the two-wire connection is provided to the heat control circuitry 144 for suitably controlling heater member 208A. The particular use of heater 208 having the above-described two-wire connection will be described below.

Figure 7:
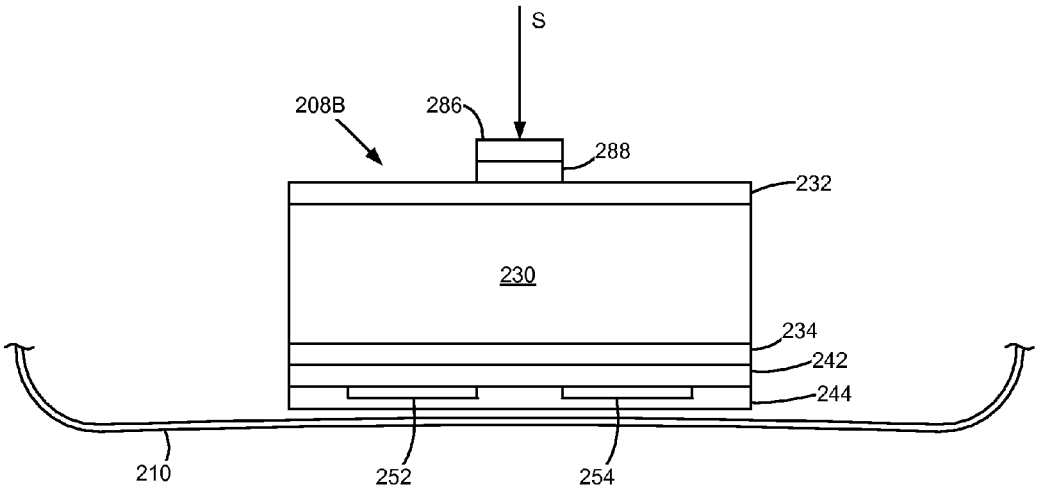
FIG. 7 is a cross sectional view of the heater member of FIG. 2 according to a second example embodiment.

FIG. 7 shows the heater member 208 of FIG. 2 according to a second example embodiment. Heater member 208B includes the basic structure of heater member 208A of FIG. 3. In addition, in this embodiment heater member 208B does not include top protective layer 240 disposed on top of electrode 232 as discussed with respect to FIG. 3. Instead, the heater member 208B includes a temperature sensor, such as a thermistor 286, disposed on an outer surface of top electrode 232. Heater member 208B also includes a glass layer 288 that is electrically insulative. This electrically insulative glass layer 288 is disposed over and may be substantially in contact with a portion of the outer surface of top electrode 232. In this embodiment, thermistor 286 is coupled to a spring assembly S of heat transfer member 202. The spring assembly S, represented by a vertical arrow in FIG. 7, may be coupled to housing 206 of heat transfer member 202 to retain thermistor 286 in a substantially fixed position on top electrode 232. The spring force from spring assembly S pushes thermistor 286 ensures accurate temperature sensing.

Figure 8:
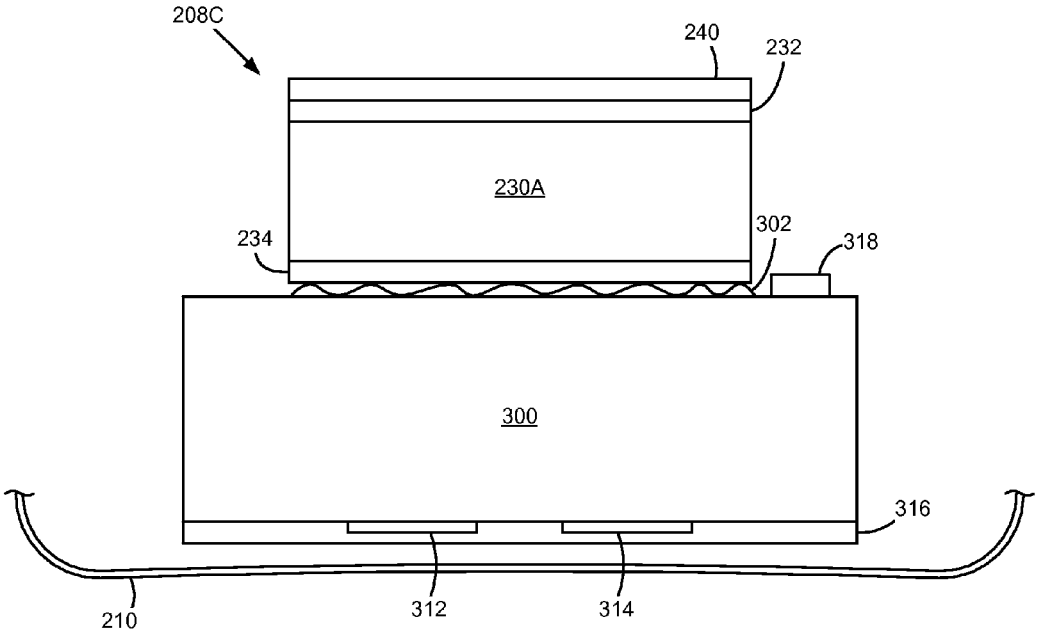
FIG. 8 is a cross sectional view of the heater member of FIG. 2 according to a third example embodiment.
Figure 9:
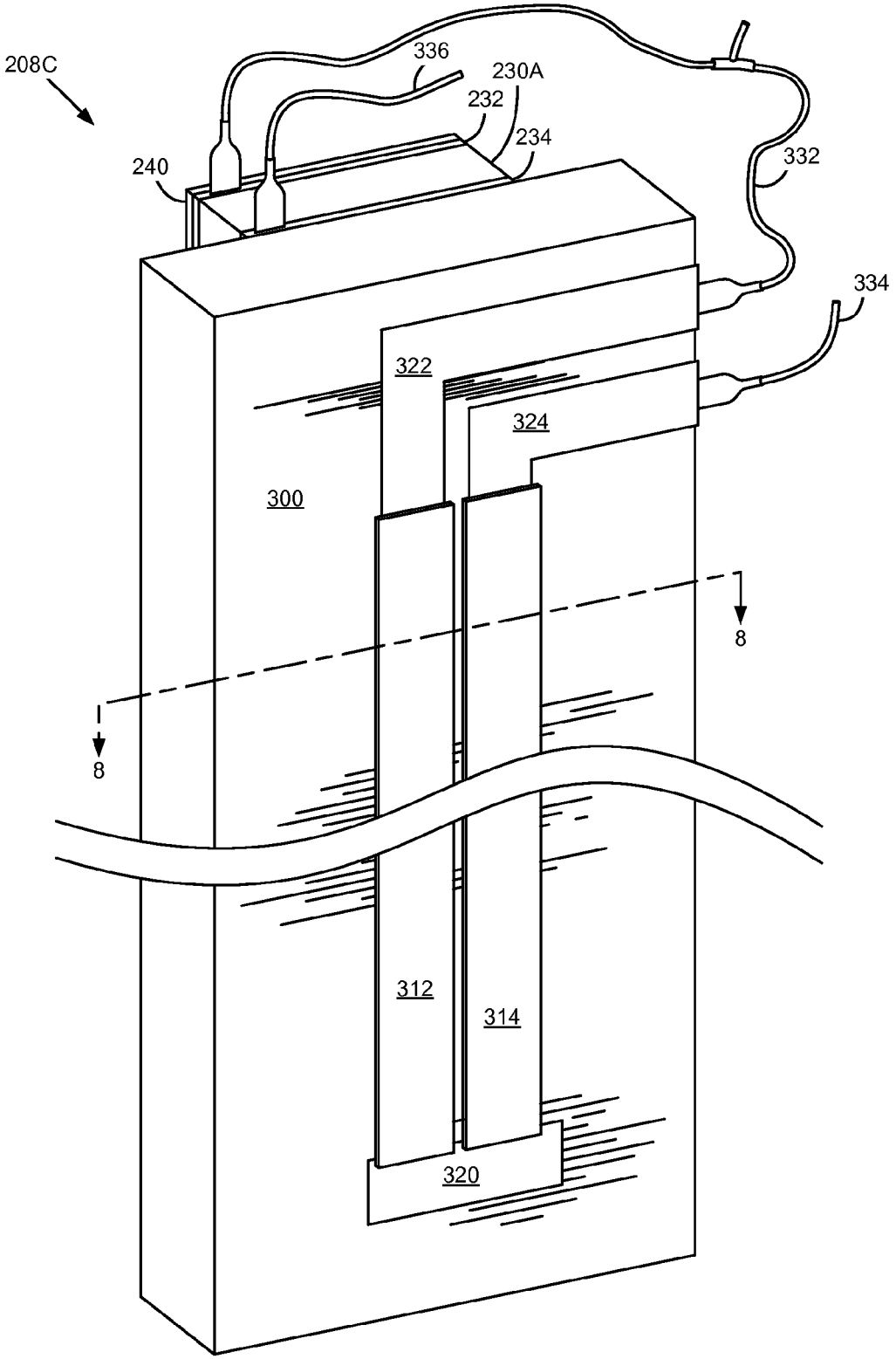
FIG. 9 is a bottom view of the heater member of FIG. 8.
Figure 10:
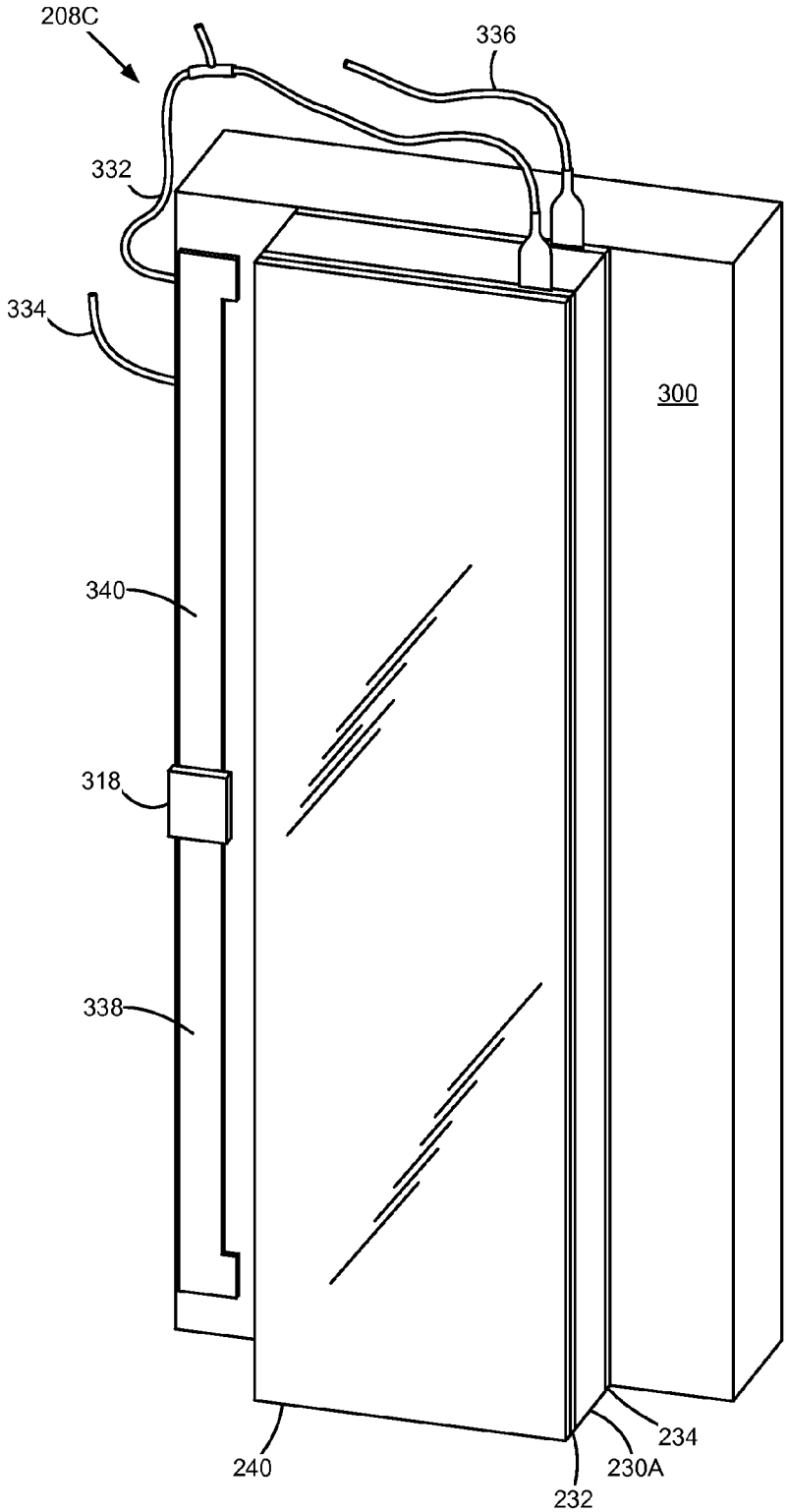
FIG. 10 is a top view of the heater member of FIG. 9.

FIGS. 8-10 depict the heater member 208 of FIG. 2 according to a third example embodiment. The heater member 208C includes PTC material 230, top and bottom electrodes 232, 234 attached at opposed sides thereof, and top protective layer 240 disposed over the outer surface of top electrode 232. The PTC material 230 used is substantially thinner than the PTC material described above in order to provide more efficient delivery of heat. In an example embodiment, the thickness of PTC material 230 may be between about 0.4 mm and about 1.6 mm, and specifically between about 0.8 mm and about 1.2 mm. To compensate for the thinner PTC material 230A, an intermediate layer between electrode 234 and resistive traces 312, 314 of the heater member 208C may include a relatively rigid substrate 300 having a length corresponding to the length of the PTC material 230A and disposed relative thereto (and electrodes 232, 234) to form a stacked arrangement therewith. A relatively rigid substrate 300 combines with the thinner PTC material 230A so as to shoulder the fuser nip forces acting on heater member 208C and prevent cracking or other deformation thereof. In an example embodiment, substrate 300 may be constructed from a ceramic material or other thermally conductive material. The ceramic material may be the same as or similar to ceramic substrates utilized in existing fuser assemblies, the particular compositions of which will not be described further for reasons of expediency.

In this embodiment, heater member 208C includes one or more resistive traces 312, 314 disposed along substrate 300, and a bottom protective layer 316 substantially covering both the outer surfaces of substrate 300 and resistive traces 312, 314 for electrical insulation and wear protection from stainless steel belt 210. Each protective layer 240 and 316 may be a glass insulative layer, a polyimide layer or the like having similar advantages described above in connection with heater member 208A of FIG. 3. Heater member 208C further includes at least one temperature sensor, such as a thermistor 318, disposed on substrate 300 along a surface thereof adjacent to the PTC material 230 and electrode 234.

In the example embodiment of FIG. 8, there is no permanent bond between PTC electrode 234 and substrate 300. Instead, a grease layer 302 may be disposed between electrode 234 and substrate 300. Grease layer 302 may be thermally conductive and electrically insulative for facilitating the efficient transfer of heat from PTC material 230A to substrate 300 so that heat is efficiently transferred to fuser belt 210 from PTC material 230 through substrate 300. In addition, because there is no permanent bond between PTC material 230 and substrate 300, the relatively thin PTC material 230A is less fragile. This is because the thermal expansion of substrate 300 may tend to stress the thinner PTC material 230A less than if PTC material 230A were permanently adhered to substrate 300.

FIG. 9 is a bottom perspective view of the heater member 208C of FIG. 8, without protective layer 316 illustrated. Dotted line 8-8 is the cross sectional view from which FIG. 8 was taken. The heater member 208C includes electrical conductors 320, 322 and 324 as well as electrical wires 332, 334 and 336. In this embodiment, electrical conductors 320, 322 and 324 are disposed on substrate 300. Electrical conductor 320 shorts together adjacent first ends of resistive traces 312 and 314. Electrical conductor 322 shorts together a second end of resistive trace 312 and wire 332, and electrical conductor 324 shorts together a second end of resistive trace 314 and wire 334.

As with the above embodiments, in this embodiment heater member 208C may be configured to connect to heat control circuitry 144 using two or three wires. In a three-wire connection with heat control circuitry 144, one PTC electrode 232, 234 is connected to an unconnected end of one resistive trace 312, 314. For example, wire 332 is connected to the unconnected end of resistive trace 312 and top PTC electrode 232, wire 334 is connected to the unconnected end of resistive trace 314, and wire 336 is connected to bottom PTC electrode 234, with wires 332, 334 and 336 coupling to heat control circuitry 144.

FIG. 10 illustrates a top view of the heater member 208C of FIG. 9. The heater member 208C includes electrical conductors 338, 340 disposed along the same surface of substrate 300 where thermistor 318 is located. The electrical conductors 338 and 340 are electrically connected to leads from thermistor 318 for coupling to controller 140. The thermistor 318 determines the temperature of heater member 208C in the same manner as thermistor 256 discussed in FIG. 5. Moreover, thermistor 318 may be substantially centered in a longitudinal direction on top of substrate 300 adjacent PTC material 230A.

Figure 11:
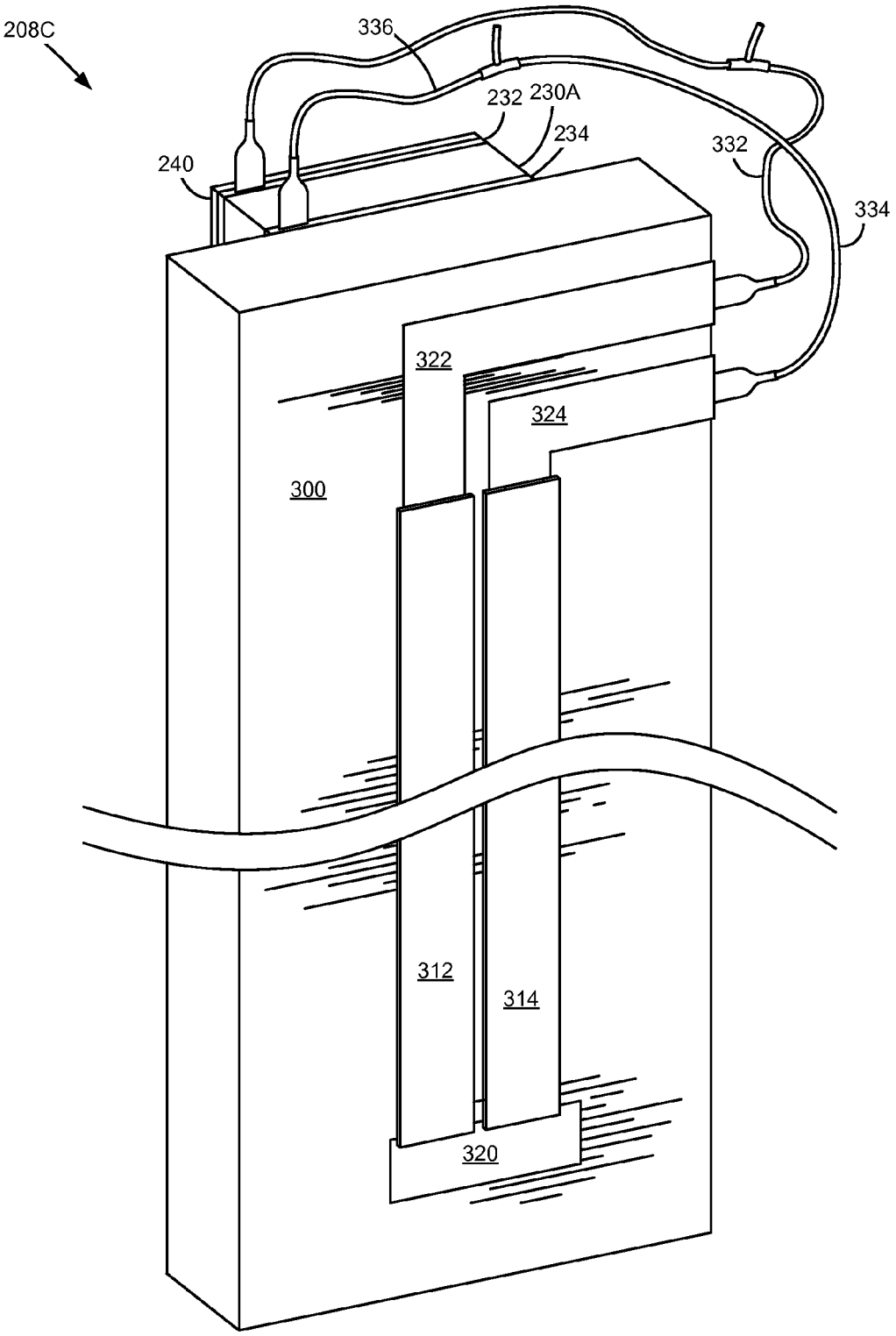
FIG. 11 is a bottom view of the heater member of FIG. 8.

In a two-wire connection with heat control circuitry 144, each of two wires shorts together a PTC electrode 232, 234 with an unconnected end of a resistive trace 312, 314. For example, as shown in FIG. 11, which is another bottom view of heater member 208C without protective layer 304 illustrated for clarity, wire 332 electrically connects the unconnected end of resistive trace 312 to top PTC electrode 232, and wire 334 electrically connects the unconnected end of resistive trace 314 to bottom PTC electrode 234 (via wire 336), with each wire 332 and 334 having an end for coupling to heat control circuitry 144. The various connections to heat control circuitry 144 for each of the two- and three-wire connections of heater member 208C, together with a description of the operation of fuser assembly 120, will be described in greater detail below.

Figure 12:
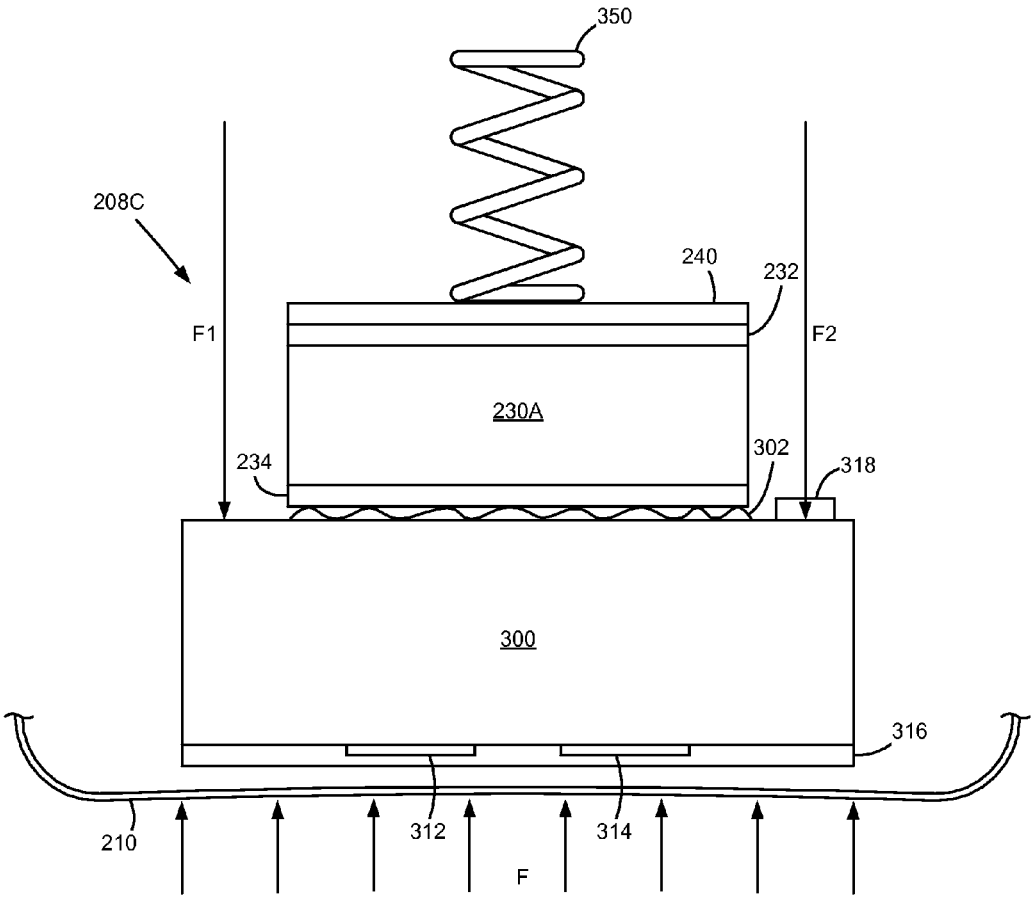
FIG. 12 is a cross sectional view of the heater member of FIG. 8 according to another example embodiment.

FIG. 12 shows the heater member 208C of FIG. 8 according to another example embodiment. Heat transfer member 202 may include a spring 350 disposed substantially over a center portion of heater member 208C along thin PTC material 230A. In one embodiment, spring 350 may be coupled and/or contact at one end to housing 206 of heat transfer member 202 and at a second end to heater member 208C. In this embodiment, spring 350 is disposed against and/or substantially in contact with top protective layer 240. FIG. 12 also shows the arrangement of counterforces F1 and F2 which are applied to heater member 208C to counteract nip forces F exerted on fuser belt 210 by backup roll 204. In particular, the counterforces F1 and F2 are used to counterbalance nip forces F, and spring 350 is used to provide a sufficient force to secure PTC material 230A in a substantially fixed position relative to substrate 300. In an example embodiment, heat transfer member 202 may utilize spring members or other known biasing mechanisms for applying counterforces F1 and F2.

Figure 13:
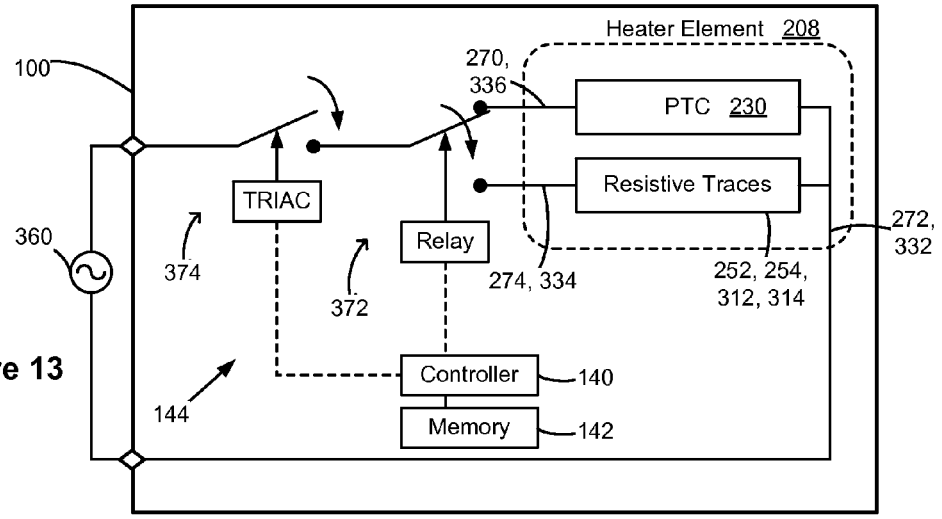
FIGS. 13, 14 and 16 are schematic diagrams illustrating example embodiments of the heat control circuitry of the image forming device of FIG. 1 connected to the heater member of FIG. 2.
Figure 14:
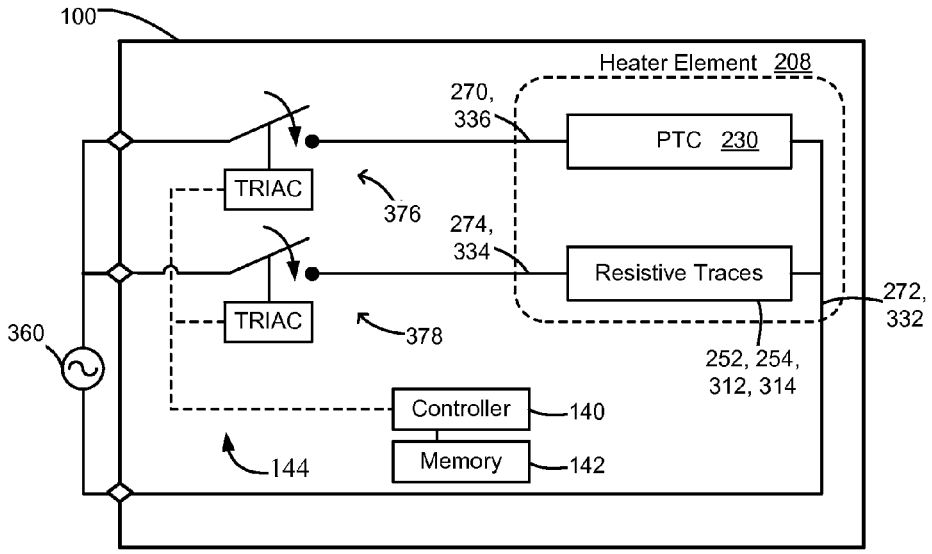
Figure 16:
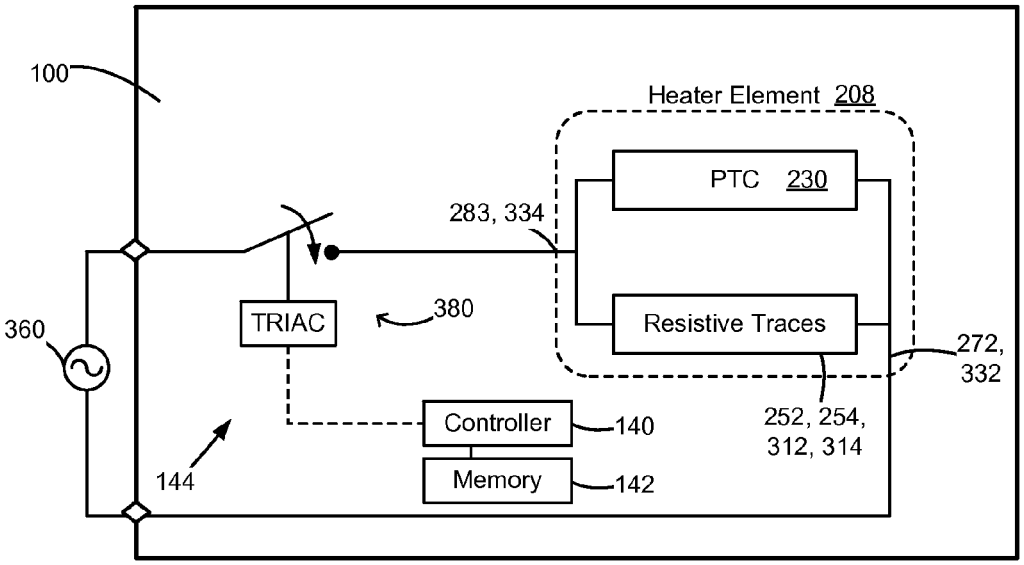

FIGS. 13, 14 and 16 show various connection configurations between the heat control circuitry 144 of image forming device 100 and fuser assembly 120, particularly heater member 208, thereof. FIG. 13 is a circuit diagram using a three-wire connection of heater member 208 of FIGS. 4 and 9 according to an example embodiment. Image forming device 100 receives an AC line voltage from AC voltage source 360 for applying AC current through heater member 208 in order to generate heat therefrom. Controller 140, through execution of firmware stored in memory 142, controls heat control circuitry 144 coupled to heater member 208 and the AC line voltage 360. In this embodiment, heat control circuitry 144 includes relay circuit 372 and triac circuit 374. As shown in FIG. 13, triac circuit 374 is controlled by controller 140 and serves as a switch for coupling heater member 208 to AC voltage source 360. Relay circuit 372 is coupled between triac circuit 374 and two of the three wires of heater member 208 (e.g., wires 270, 274 for heater member 208A, and wires 334 and 336 for heater member 208C). A second terminal of the AC voltage source 360 is also coupled to heater member 208, by coupling to wires 272 (FIG. 4) and 332 (FIG. 9). Relay circuit 372 is controlled by controller 140 for switching between providing current through (and generating heat from) the resistive traces of heater member 208 and providing current through (and generating heat from) PTC material 230 thereof. In this way, heat control circuit 144 may control heat generated by heater member 208 so one or more of PTC material 230 and resistive traces of heater member 208 may generate heat during a fusing operation.

For instance, triac circuit 374 and relay circuit 372 may be controlled by controller 140 so as to couple PTC material 230 of heater member 208 to the AC voltage source 360 when fusing media that is narrower than full width media. In addition, triac circuit 374 and relay circuit 372 may be controlled by controller 140 so as to couple the resistive traces of heater member 208 when fusing full width media. Still further, in a third heater control approach, triac circuit 374 and relay circuit 372 may be controlled by controller 140 so as to alternatingly couple both the resistive traces of heater member 208 and PTC material 230 to the AC voltage source 360 when fusing narrower media. Specifically, relay circuit 372 may initially provide AC current through the resistive traces of heater member 208 to suitably heat up heater member 208 before providing AC current through PTC material 230 to complete a fusing operation on narrower media. This allows for faster heater warm up (i.e., by bypassing the slower warm up time for PTC material) while advantageously using PTC material 230 to fuse narrower media so as to prevent fuser overheating.

FIG. 14 illustrates heat control circuitry 144 and the same three-wire connection for controlling heater member 208, according to an alternative example embodiment. In this case, heat control circuitry 144 utilizes a dual triac configuration. Triac circuits 376 and 378 are communicatively coupled to controller 140 so as to be controlled thereby. Triac circuits 376 and 378 are parallel connected between the AC voltage source 360 and heater member 208, with triac circuit 376 having a terminal connected to PTC material 230 (wire 270 in FIG. 4 and wire 336 in FIG. 9) and triac circuit 378 having a terminal connected to the resistive traces of heater member 208 (wire 274 in FIG. 4 and wire 334 in FIG. 9). A second terminal of AC voltage source 360 may be coupled to heater member 208 through wire 272 (FIG. 4) and wire 332 (FIG. 9).

In the example embodiment of FIG. 14, controller 140 may control triac circuits 376, 378 prior to and during a fusing operation so that either the resistive traces or PTC material 230 of heater member 208 is activated to generate heat, similar to the functionality of the embodiment of FIG. 13. In addition, controller 140 may control triac circuits 376 and 378 so that both the resistive traces and PTC material 230 may be simultaneously activated to generate heat. For example, at room temperature, resistive traces 252, 254 (FIG. 4) and 312, 314 (FIG. 9) may be activated to generate heat during a warm-up operation prior to a fusing operation. This is done closing triac circuit 378 to connect AC line voltage 360 to the resistive traces of heater member 208. After warm-up, if fusing narrower media, triac circuit 378 is opened and triac circuit 376 is closed to connect AC line voltage 360 to PTC material 230. The PTC material 230, which provides less heat during the warm-up operation than the operating wattage normally specified, is thereby activated after warm-up for fusing toner to a narrow media during a fusing operation. After warm-up, if printing on full width media, triac circuit 378 remains closed and triac circuit 376 remains open so that the resistive traces of heater member 208 are used to fuse toner to the full width media during the fusing operation. Further, use of triac circuits 376 and 378 provides flexibility for a power boost for relatively short periods of time by simultaneously activated both PTC material 230 and the resistive traces of heater member 208 by simultaneously closing triac circuits 376 and 378. This power boost is advantageous in cold environments (even as low as about 10 C) to assure a relatively fast warm-up time and time-to-first-print. For example, if PTC material 230 provides 600 W (300 W at cold temperatures) and the resistive traces of heater member 208 provide 1200 W, the total warm-up power could be as much as 1500 W. If used alone, PTC material 230 would provide less than 600 W when in cold environments.

Figure 15:
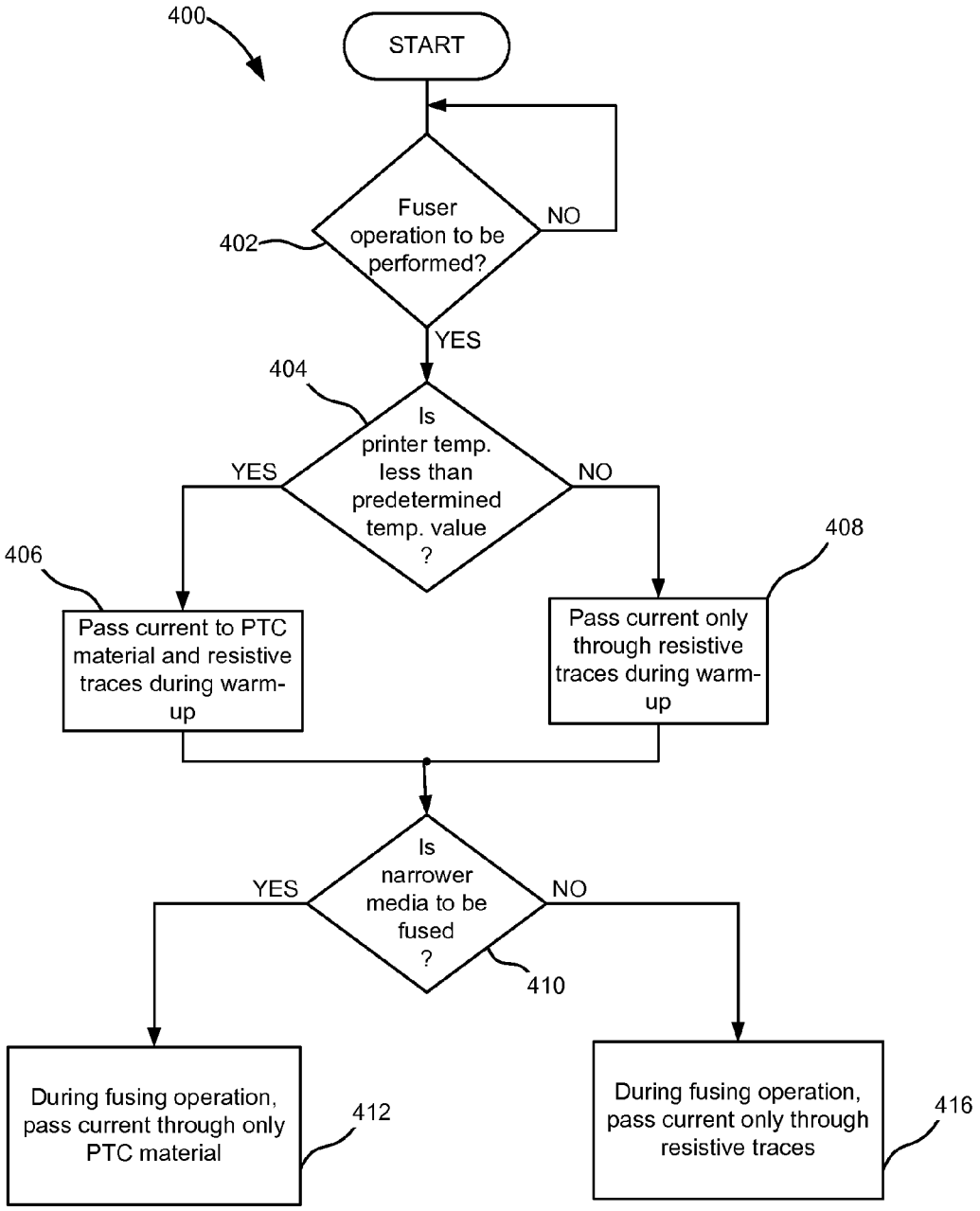
FIG. 15 is a flow chart illustrating the operation of the example embodiments of FIGS. 13 and 14.

FIG. 15 illustrates a method 400 for performing fusing operations by the embodiments of FIGS. 13 and 14. Controller 140 determines at 402 whether a fusing operation is to be performed. For the embodiment of FIG. 14, upon an affirmative determination, controller 140 may then determines at 404 the temperature of image forming device 100 and compares said temperature with a predetermined temperature value corresponding to temperature in cold environments. If the temperature of image forming device 100 is less than the predetermined temperature value, controller 140 may initiate a warm-up operation at 406 during which both PTC material 230 and the resistive traces of heater member 208 are simultaneously activated for generating heat. This may be accomplished by controller 140 controlling triac circuits 376 and 378 for simultaneously passing current to PTC material 230 and the resistive traces of heater member 208.

If the temperature of image forming device 100 is greater than the predetermined temperature for the embodiment of FIG. 14, a warm-up operation is initiated at 408 during which current is passed through the resistive traces of heater member 208, without passing current through PTC material 230. This is accomplished by controller 140 controlling triac circuit 378 in FIG. 14 so as to connect the resistive traces to AC line voltage 360. Because the embodiment of FIG. 13 is not configured to simultaneously activate PTC material 230 and the resistive traces of heater member 208, following an affirmative determination at 402 that a fuser operation is to be performed, the warm-up operation at 408 is performed regardless of the temperature of image forming device 100. This is accomplished by controlling relay circuit 372 to direct current to the resistive traces of heater member 208.

Thereafter, method 400 proceeds to 410 wherein controller 140 determines whether narrow media is to be fused by fuser assembly 120. Upon an affirmative determination, PTC material 230 is activated at 412 to generate heat during the fusing operation to fuse toner to narrow media. PTC material 230 serves to prevent the portions of backup roll 204 and heat transfer member 202 which do not contact the media sheets from overheating. PTC material 230 is activated in the embodiment of FIG. 13 by controlling relay circuit 372 to direct current to PTC material 230. PTC material 230 is activated in the embodiment of FIG. 14 by controlling (closing) triac circuit 376 to direct current to PTC material 230 and controlling (opening) triac circuit 378 to prevent current from being directed to the resistive traces of heater member 208. With PTC material 230 activated, the fusing operation is performed.

With respect to FIG. 16, a circuit diagram is shown of heat control circuitry 144 with heater member 208 using the two-wire connection configuration of FIGS. 6 and 11, according to another example embodiment. Heat control circuitry 144 includes triac circuit 380 which is connected to both PTC material 230 and resistive traces of heater member 208 (heater member 208A of FIG. 6 and heater member 208C of FIG. 11). In this embodiment, triac circuit 380 serves as a switch to simultaneously provide current to both PTC material 230 and the resistive traces. Firmware maintained in memory 142 and executed by controller 140 includes a software control algorithm to control triac circuit 380. The algorithm in the firmware may control closing and opening of connections to heater member 208 throughout a fusing operation. This two-wire connection offers the most economical method to take advantage of heater member 208.

The above-described firmware control algorithm is utilized for the embodiment of FIG. 16 because both PTC material 230 and the resistive traces of heater member 208 are energized whenever heat is to be generated. For example, a total heat output at operating temperature is assumed at about 1200 W, for example. To apportion the 1200 W between PTC material 230 and the resistive traces, an experiment may be performed to balance the need for resistive trace heating (for warm-up) and the need for PTC material heating (for narrow media). The experiment therefore may yield, for example, PTC material 230 to be at about 600 W and the resistive traces to be at about 600 W. Since the resistive traces would only be at 600 W versus a more typical 1200 W setting, the portions of fuser nip N not in contact with media sheets would only heat half as fast when printing the narrow media, thereby offering significant improvement over the more typical heating performance.

Heater member 208, as described hereinabove and illustrated in FIGS. 3-12, may be utilized to generate heat in applications other than to fuse toner to sheets of media, such as cooking and small appliance heater applications. For instance, heater members 208A-208D may be used in a cooking stovetop as a heating element to replace conventional resistance heating elements. A cooking pan resting on the stovetop which is smaller than the heating element may create a temperature difference along the stovetop. In this scenario, the outer portion of heating element would be hotter than the inner portion thereof which has the thermal load of the cooking pan, but PTC material 230 would provide more uniform heating due to the self regulating properties of PTC material 230.

As explained above with respect to FIG. 15, by utilizing both the resistive traces of heater member 208 and PTC material 230 to generate heat, heater member 208 may provide for a shorter period to reach the desired heated temperature, for any application. The availability of both PTC material 230 and the resistive traces additionally results in heat member 208 having more heating options and/or settings. For instance, if the environment in which a heating application exists is too cold for the maximum heating capacity of PTC material of a conventional PTC heater, additional utilization of the resistive traces of heater member 208 may provide a heating boost.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A heater, comprising:

a positive temperature coefficient (PTC) material having a first surface and an opposed second surface, a length of the PTC material sized to extend substantially across a width of a fuser nip of a fuser assembly;

first and second electrodes, the first electrode being disposed against the first surface of the PTC material and the second electrode being disposed against the second surface thereof, the first and second electrodes for applying a voltage differential across the PTC material to generate heat therefrom;

at least one intermediate layer disposed against the second electrode;

at least one resistive trace disposed along the at least one intermediate layer so as to extend substantially across the length of the PTC material, the at least one resistive trace for generating heat upon passage of a current therethrough; and a protective layer covering the at least one resistive trace and the at least one intermediate layer, wherein the heater further comprises a first conductor disposed along the at least one intermediate layer and the second electrode for electrically connecting the second electrode and a first end portion of the at least one resistive trace.

2. The heater of claim 1, wherein the at least one intermediate layer comprises a glass layer.

3. The heater of claim 1, wherein the at least one intermediate layer comprises a polyimide layer.

4. A heater, comprising:

a positive temperature coefficient (PTC) material having a first surface and an opposed second surface, the PTC material sized to extend substantially across a width of a fuser nip of a fuser assembly;

first and second electrodes, the first electrode being disposed against the first surface of the PTC material and the second electrode being disposed against the second surface thereof, the first and second electrodes for applying a voltage differential across the PTC material to generate heat therefrom;

at least one intermediate layer disposed against the second electrode;

at least one resistive trace disposed along the at least one intermediate layer so as to extend substantially across a length of the PTC material, the at least one resistive trace for generating heat upon passage of a current therethrough; and at least one protective layer covering the at least one resistive trace and the at least one intermediate layer, wherein the at least one intermediate layer comprises a substrate having a length substantially corresponding to the length of the PTC material, the substrate having no permanent bond with the second electrode.

5. The heater of claim 4, wherein the at least one intermediate layer further comprises a thermally conductive layer disposed between the second electrode and the substrate.

6. The heater of claim 5, wherein the thermally conductive layer directly contacts the second electrode and the substrate.

7. The heater of claim 4, wherein the substrate comprises a ceramic material.

8. The heater of claim 1, wherein the at least one protective layer comprises at least one layer of polyimide material.

9. The heater of claim 1, further comprising a second conductor connected to a second end portion of the at least one resistive trace, a first wire connected to the first conductor and a second wire connected to the second conductor.

10. A fuser assembly, comprising:

a housing;

a belt rotatably positioned about the housing and having an inner surface;

a backup roll disposed substantially against the belt so as to form a fuser nip therewith; and a heater member disposed substantially within the housing, the heater member including:

a positive temperature coefficient (PTC) material having a first surface and an opposed second surface, a length of the PTC material sized to extend substantially across a width of the fuser nip;

first and second electrodes, the first electrode being disposed against the first surface of the PTC material and the second electrode being disposed against the second surface thereof, the first and second electrodes for applying a voltage differential across the PTC material to generate heat therefrom;

at least one intermediate layer disposed against the second electrode;

at least one resistive trace disposed along the at least one intermediate layer so as to extend substantially across the length of the PTC material, the at least one resistive trace for generating heat upon passage of a current therethrough, and the at least one resistive trace disposed in proximity to the inner surface of the belt for heating thereof; and a protective layer covering the at least one resistive trace and the at least one intermediate layer, wherein the heater member further comprises a first conductor disposed along the intermediate layer and the second electrode for electrically connecting the second electrode and a first end portion of the at least one resistive trace.

11. The fuser assembly of claim 10, wherein one or more of the at least one intermediate layer and the protective layer comprises polyimide material.

12. A fuser assembly, comprising:

a housing;

a belt rotatably positioned about the housing and having an inner surface;

a backup roll disposed substantially against the belt so as to form a fuser nip therewith; and a heater member disposed substantially within the housing, the heater member including:

a positive temperature coefficient (PTC) material having a first surface and an opposed second surface, a length of the PTC material sized to extend substantially across a width of the fuser nip;

first and second electrodes, the first electrode being disposed against the first surface of the PTC material and the second electrode being disposed against the second surface thereof, the first and second electrodes for applying a voltage differential across the PTC material to generate heat therefrom;

at least one intermediate layer disposed against the second electrode;

at least one resistive trace disposed along the at least one intermediate layer so as to extend substantially across the length of the PTC material, the at least one resistive trace for generating heat upon passage of a current therethrough, and the at least one resistive trace disposed in proximity to the inner surface of the belt for heating thereof; and at least one protective layer covering the at least one resistive trace and the at least one intermediate layer, an outermost surface of the at least one protective layer contacting the inner surface of the belt at the fuser nip, wherein the at least one intermediate layer comprises a substrate having a length corresponding to the length of the PTC material, the substrate and the second electrode not being permanently bonded to each other.

13. The fuser assembly of claim 12, wherein the at least one intermediate layer further comprises a thermally conductive layer disposed between the second electrode and the substrate.

14. The fuser assembly of claim 13, wherein the thermally conductive layer directly contacts and is disposed between the second electrode and the substrate.

15. The fuser assembly of claim 12, wherein the substrate comprises a ceramic substrate.

16. The fuser assembly of claim 12, further comprising at least one bias member disposed between the first electrode and the housing for securing the first electrode, the PTC material and the second electrode relative to the substrate.

17. The fuser assembly of claim 10, further comprising at least one bias member having a first end and an opposed second end, the first end disposed substantially over a center portion along a width of the PTC material to directly contact the heater member, and the opposed second end disposed substantially against the housing.

18. The heater of claim 4, further comprising at least two wires coupled to the first and second electrodes and the at least one resistive trace, the at least two wires defining a first current path through the PTC material and a second current path through the at least one resistive trace, the first current path being separate from the second current path.

19. The heater of claim 4, further comprising at least two wires coupled to the first and second electrodes and the at least one resistive trace, the at least two wires defining parallel current paths through the heater, including a first current path through the PTC material and a second current path through the at least one resistive trace.

20. The heater of claim 5, wherein the thermally conductive layer comprises a thermally conductive grease layer.

21. The fuser assembly of claim 12, further comprising at least two wires coupled to the first and second electrodes and the at least one resistive trace, the at least two wires defining a first current path through the PTC material and a second current path through the at least one resistive trace, the first current path being separate from the second current path.

22. The fuser assembly of claim 12, further comprising at least two wires coupled to the first and second electrodes and the at least one resistive trace, the at least two wires defining parallel current paths through the heater member, including a first current path through the PTC material and a second current path through the at least one resistive trace.

23. The fuser assembly of claim 12, wherein the at least one protective layer comprises at least one layer of glass or polyimide.

24. The fuser assembly of claim 12, wherein the at least one protective layer comprises at least one polyimide layer.

25. The fuser assembly of claim 13, wherein the thermally conductive layer comprises a thermally conductive grease layer.

* * * * *